US009057985B2

(12) United States Patent
Tanaka

(10) Patent No.: US 9,057,985 B2
(45) Date of Patent: Jun. 16, 2015

(54) IMAGE FORMING APPARATUS

(71) Applicant: CANON KABUSHIKI KAISHA, Tokyo (JP)

(72) Inventor: Shigeru Tanaka, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 22 days.

(21) Appl. No.: 13/727,755

(22) Filed: Dec. 27, 2012

(65) Prior Publication Data

US 2013/0183049 A1 Jul. 18, 2013

(30) Foreign Application Priority Data

Jan. 13, 2012 (JP) ..... 2012-004903

(51) Int. Cl.
*G03G 15/00* (2006.01)
*G03G 15/08* (2006.01)
*G03G 21/20* (2006.01)

(52) U.S. Cl.
CPC ..... *G03G 15/0877* (2013.01); *G03G 15/0848* (2013.01); *G03G 15/5004* (2013.01); *G03G 21/20* (2013.01)

(58) Field of Classification Search
CPC ..... G03G 21/20; G03G 21/203
USPC ..... 399/44, 46
See application file for complete search history.

(56) References Cited

U.S. PATENT DOCUMENTS

| | | | | |
|---|---|---|---|---|
| 8,688,014 | B2 * | 4/2014 | Shigehiro | 399/258 |
| 8,712,263 | B2 | 4/2014 | Tanaka | |
| 2009/0129792 | A1 * | 5/2009 | Izumi et al. | 399/27 |
| 2011/0293300 | A1 | 12/2011 | Tanaka | |
| 2012/0134690 | A1 | 5/2012 | Tanaka | |
| 2014/0199088 | A1 | 7/2014 | Tanaka | |

FOREIGN PATENT DOCUMENTS

| | | | |
|---|---|---|---|
| JP | 2000-29295 | A | 1/2000 |
| JP | 2006-65124 | A | 3/2006 |
| JP | 2006-201576 | A | 8/2006 |
| JP | 4260085 | B2 | 4/2009 |
| JP | 4609077 | B2 | 1/2011 |
| JP | 2012-118202 | A | 6/2012 |

* cited by examiner

*Primary Examiner* — Gregory H Curran
(74) *Attorney, Agent, or Firm* — Fitzpatrick, Cella, Harper & Scinto

(57) ABSTRACT

An image forming apparatus includes an image bearing member, a development device, a supply developer container, a supply developer supply member, a toner density detecting portion, and a controller. The controller controls an image formation condition based on first information regarding a humidity of the developer accommodated in the developing device, second information regarding a humidity of the developer accommodated in the supply device, and third information regarding a supply amount supplied by the supply device.

13 Claims, 9 Drawing Sheets

IMAGE FORMING APPARATUS

BACKGROUND OF THE INVENTION

1. Field of the Invention

The present invention relates to an image forming apparatus of an electrophotographic system such as a printer or a copying machine, and more particularly, to an image forming apparatus that uses a dry two-component development system and supplies a developer to a developing device by a toner supply device.

2. Description of the Related Art

Conventionally, in image forming apparatuses in which a two-component developer is used, a toner supply device is configured to supply an appropriate amount of toner to a developing device. Japanese Patent Laid-Open No. 2006-201576 discloses a system in which toner is determined not to be present by detecting that a decrease in the toner density of a developer is less than a threshold value by a predetermined number of times.

However, in the technology disclosed in Japanese Patent Laid-Open No. 2006-201576, a problem of a change in the image density is not sufficiently solved.

According to an examination of the applicants, it has been known that the temperature and humidity of a developer receive an influence of the temperature and humidity of supplied toner and the degree of the influence increases as differences of the temperature and humidity between the developer and the toner and the amount of supplied toner increase. This is a cause of the change in an image density which is a problem of the related art.

It is desirable to provide an image forming apparatus capable of suppressing a change in an image density caused due to the temperature and humidity of supplied toner.

SUMMARY OF THE INVENTION

According to an aspect of the invention, there is provided an image forming apparatus including: a developing device that accommodates a developer formed of at least toner and a carrier and visualizes an electrostatic latent image carried on an image bearing member as a toner image; a supply device that accommodates a developer including at least the toner and supplies the developer to the developing device; and a controller that controls an image formation condition based on first information regarding a humidity of the developer accommodated in the developing device, second information regarding a humidity of the developer accommodated in the supply device and third information regarding a supply amount supplied by the supply device.

In the above-described configuration, the toner density detection is performed with higher accuracy and the change in the image density is further suppressed.

Further features of the present invention will become apparent from the following description of exemplary embodiments with reference to the attached drawings.

DESCRIPTION OF THE EMBODIMENTS

Figure 1:
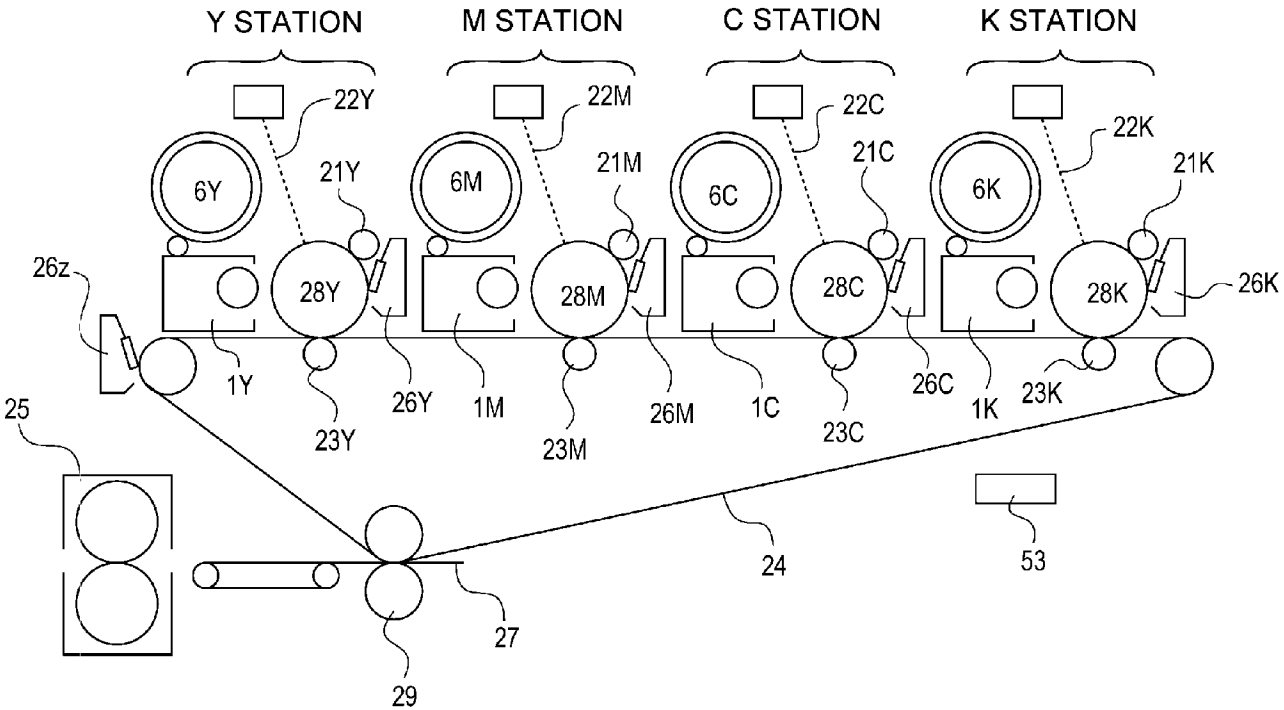
FIG. 1 is a schematic diagram illustrating an image forming apparatus according to a first embodiment.

[First Embodiment] A first embodiment of the invention will be described. FIG. 1 is a schematic diagram illustrating an image forming apparatus according to the first embodiment.

As illustrated in FIG. 1, the image forming apparatus according to this embodiment is a so-called tandem type full-color image forming apparatus that includes stations (image forming portions) that form toner images of yellow (Y), magenta (M), cyan (C), and black (K), respectively. Each station includes a photosensitive drum 28 (28Y, 28M, 28C, or 28K) that carries a toner image of each color. Since the configuration of each station is the same, suffixes of (Y, M, C, K) are not presented in the following description, as necessary.

An image formation flow is as follows. First, in the image forming apparatus, each station visualizes the toner image (generates an image) of each color, and the toner images of the four colors can be superimposed on an intermediate transfer belt 24 (intermediate transfer member). Thereafter, the toner images of the four colors are collectively secondarily transferred to a transfer material 27 by a secondary transfer roller 29 (secondary transfer portion). The transfer material 27 to which the toner images of the four colors are transferred is subjected to heating and pressing by a fixing member 25, and thus the toner images are fixed to the transfer material 27 to become a permanent image. The residual toner which has not been transferred to the transfer material 27 is removed by an intermediate transfer belt cleaner 26*z*.

Figure 2:
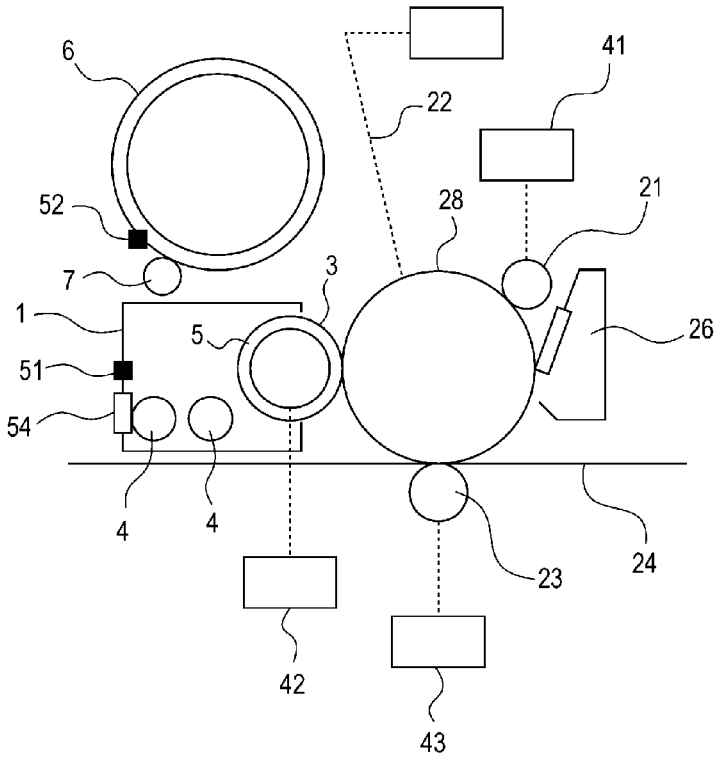
FIG. 2 is a diagram illustrating the details of the configuration of each station according to the first embodiment.

FIG. 2 is a diagram illustrating the details of the configuration of each station according to the first embodiment. In the description of the reference signs, suffixes associated with the colors (Y, M, C, and K) are not presented as necessary.

First, the surface of the photosensitive drum 28 (image bearing member) rotated counterclockwise is charged by a primary charger 21 and is exposed with a laser 22 from an exposure device. Thus, an electrostatic latent image is formed on the photosensitive drum 28.

The electrostatic latent image is developed by supplying the toner from a development device 1 and the toner image is obtained. The toner images of the respective colors are primarily transferred to be superimposed on the intermediate transfer belt 24 which comes into direct contact with the photosensitive drum 28 by a primary transfer charger 23 (primary transfer portion). The residual toner remaining on the photosensitive drum 28 after the primary transfer is removed by a cleaner 26.

Figure 3:
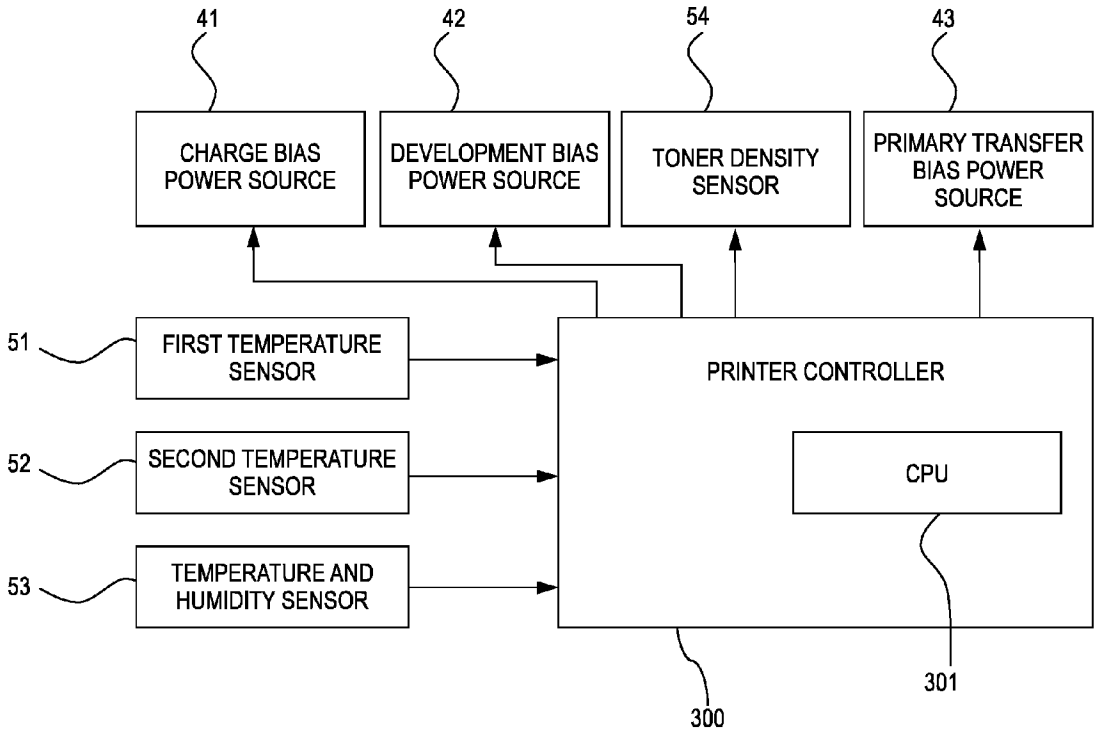
FIG. 3 is a block diagram illustrating control according to the first embodiment.

FIG. 3 is a block diagram illustrating control according to the first embodiment. As illustrated in FIGS. 2 and 3, each station includes power sources to apply a charge bias, a development bias, and a primary transfer bias. Specifically, each station may include a charge bias power source 41, a development bias power source 42, and a primary transfer bias power source 43. A printer controller 300 causes a CPU 301 or the like included therein to control the process of each of the above-described portions of the image forming apparatus and the bias power sources.

The surface of the photosensitive drum 28 is uniformly charged with the charge bias applied from the charge bias power source 41 to the primary charger 21. The uniformly charged potential on the photosensitive drum 28 is referred to as a blank part potential or Vd (V). The charge bias is a bias in which an alternating-current component is superimposed on a direct-current component Vchg (V). In such an "AC charge system", the alternating-current component is adjusted so that the value of Vchg (V) becomes nearly Vd (V).

Next, an exposure portion (not illustrated) drives the laser 22 based on a signal corresponding to the level of image data (image signal). When a Vd (V) portion on the photosensitive drum 28 is irradiated with the laser 22, an electrostatic latent image is formed. Here, the potential of a portion on which exposure is performed using the laser 22 set to have a predetermined light-emission intensity at an exposure time ratio corresponding to image data of the maximum density portion is referred to as a maximum density part potential or Vl (V).

The development device 1 will be described in detail. In this embodiment, a developer accommodated in the development device 1 is a "two-component development type" developer in which non-magnetic toner and a magnetic carrier are mixed.

The non-magnetic toner is toner produced by pulverizing and classifying a resin in which colorants of black, cyan, magenta, and yellow and wax serving as a fixing auxiliary agent are mixed in polyester serving as a main agent. As the toner resin, not only polyester used in this embodiment but also a styrene acrylic resin, a mixture thereof, or the like can be used. Not only the pulverizing and classifying method used in this embodiment but also a polymerization method in which spherical toner can be produced can be used.

A carrier produced by coating a core formed of ferrite with a silicon resin can be used as the magnetic carrier. A magnetic resin particle or the like formed in a spherical shape by solidifying a magnetic powder such as magnetite using a phenol resin or the like may be used as the core. A styrene acrylic material, a fluorine material, or other various materials may be used as a coat agent. A toner weight % in the two-component developer is referred to as a TD ratio (%). In the initial state, the two-component developer is mixed so that the toner weight % is 8% of each color.

A development sleeve 3 that faces the photosensitive drum 28 is installed in an opening of the development device 1 and is rotated clockwise in FIGS. 1 and 2. The development sleeve 3 can include a magnet 5 inside the development sleeve 3. Therefore, the development sleeve 3 carries the two-component developer by the magnetic force of the magnet 5 and conveys the carried two-component developer to the surface of the photosensitive drum 28.

A development bias in which an alternating-current component is superimposed on a predetermined direct-current component Vdev (V) by the development bias power source 42 is applied to the development sleeve 3. The absolute value of a difference "Vl−Vdev" is referred to as Vcont and indicates the potential of the maximum density part of the electrostatic latent image viewed from the development sleeve 3.

The absolute value of "Vd−Vdev" is referred to as Vback and is a potential difference provided to ensure toner fogging of the blank part.

A sum of Vcont and Vback is equal to the difference between Vd and Vl and is referred to as a latent image contrast. When the maximum exposure amount is determined, Vl is uniquely determined for Vd. That is, by adjusting Vd, the latent image contrast can be adjusted, and thus a predetermined relational expression is present between Vd and the latent image contrast.

The printer controller 300 stores the predetermined relational expression, and thus determines the appropriate value of Vd, that is, a direct-current component Vchg of the charge bias from the value Vcont/Vback to be required. Further, a value obtained by subtracting the value of Vback from the direct-current component Vchg is a direct-current component Vdev of the development bias.

When the toner is consumed by forming a toner image, the amount of toner corresponding to the amount of consumed toner is supplied from a toner bottle 6 (supply developer container) to the development device 1.

To determine a supply toner amount z(g), the printer controller 300 calculates a difference value ΔTD (%) from a difference between a toner density detection result of a toner density sensor 54 (toner density detecting portion) and a toner density reference value. Then, the supply toner amount is determined by changing a driving time s (msec) of a supply screw 7 (supply developer supplying member) according to this difference value.

A density detecting method performed by the toner density detecting portion can be determined based on the characteristics (optical characteristics or magnetic characteristics) of the developer contained in the development device 1. Further, the density detecting method can be also determined based on an attachment amount of a reference toner image obtained by developing a reference latent image which is formed on the photosensitive drum 28 by the development device 1. In this embodiment, any method may be used.

Figure 4:
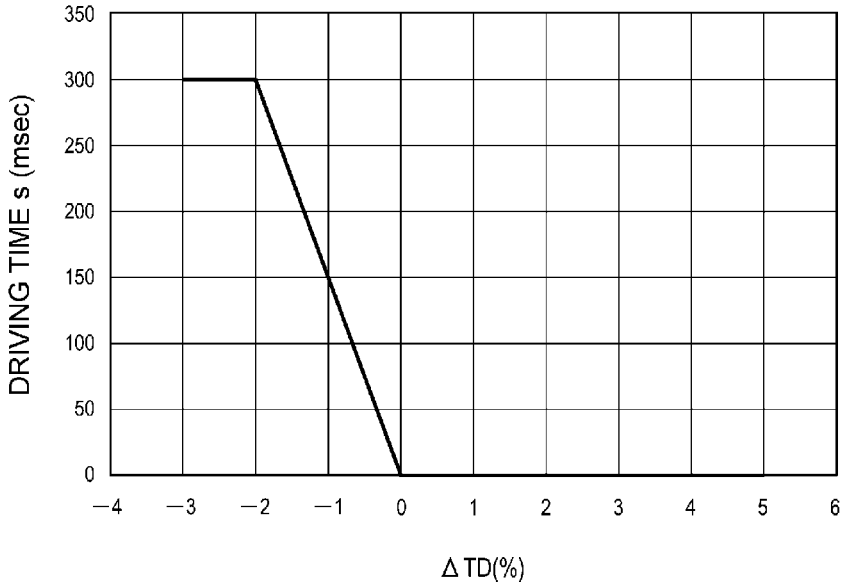
FIG. 4 is a graph illustrating a relation between ΔTD and a driving time of a supply screw according to the first embodiment.

FIG. 4 is a graph illustrating a relation between the difference value ΔTD and a driving time of the supply screw according to the first embodiment. A driving time s is calculated for the difference value ΔTD with reference to a toner supply table of FIG. 4. The toner density reference value is a detection result of the toner density in the initial state (a state in which a TD ratio of the two-component developer is 8%).

As illustrated in FIGS. 2 and 3, a first temperature sensor 51 is installed in the development device 1 of each color. The first temperature sensor 51 detects a temperature T of the development device 1 and notifies the printer controller 300 of the temperature T. A second temperature sensor 52 is installed in the toner bottle 6 of each color. The second temperature sensor 52 detects a temperature t of the toner bottle 6 and notifies the printer controller 300 of the temperature t.

The first temperature sensor 51 and the second temperature sensor 52 are preferably disposed inside the development device 1 and the toner bottle 6, respectively. This is because the temperature of the two-component developer inside the development device 1 and the temperature of the supply toner inside the toner bottle 6 can be measured with the highest accuracy. When there is a restriction on the installation and there is a possibility of exchanging of the development device 1, the temperature sensor may come into contact with the outer wall of the development device 1 or the toner bottle 6 or the vicinity of the development device or the toner bottle to roughly measure the temperature. As illustrated in FIG. 1, the image forming apparatus can include a temperature and humidity sensor 53 (temperature and humidity detecting portion) that measures the atmosphere inside the image forming apparatus and the vicinity of the image forming apparatus.

Figure 5:
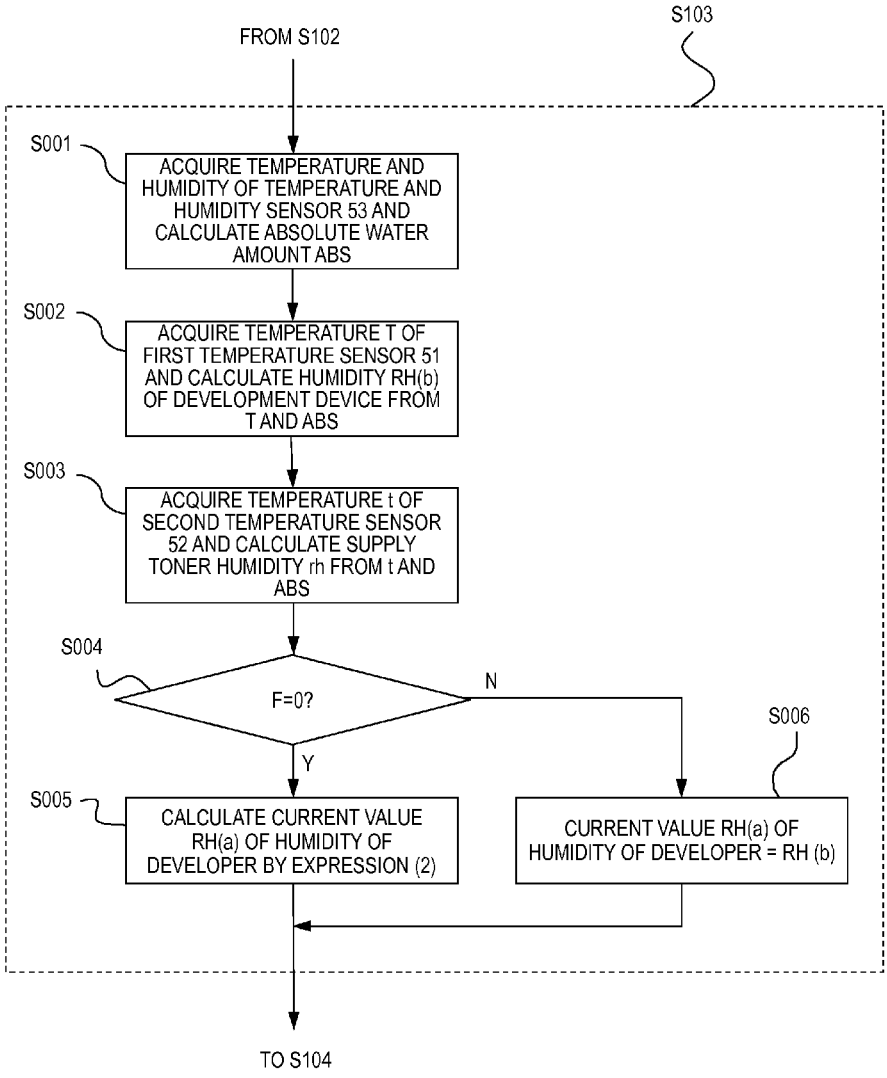
FIG. 5 is a flowchart illustrating control of humidity calculation according to the first embodiment.
Figure 6:
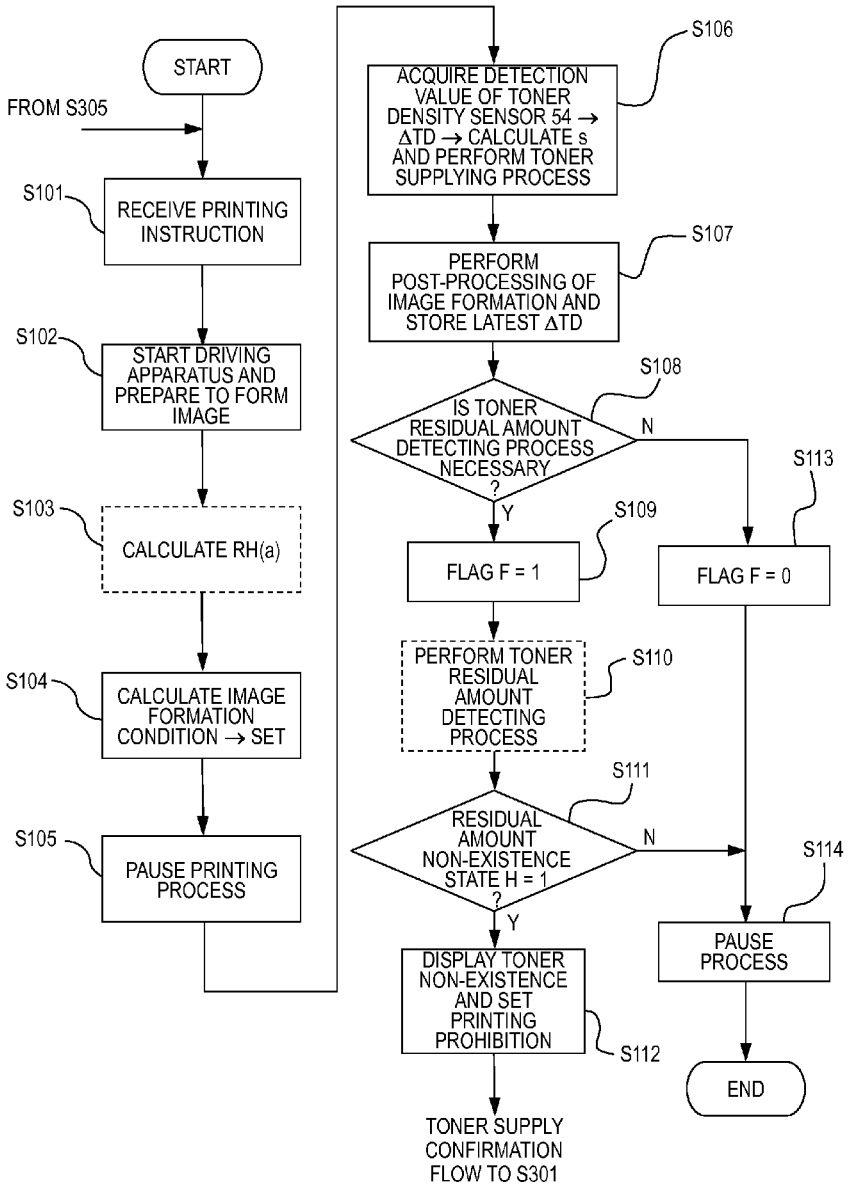
FIG. 6 is a flowchart illustrating overall control according to the first embodiment.

(Characteristics of Embodiment) Next, the characteristics of control according to this embodiment will be described with reference to flowcharts. FIG.5 is a flowchart illustrating control of humidity calculation according to the first embodiment. FIG. 6 is a flowchart illustrating overall control according to the first embodiment. The flowchart of FIG. 5 is a part of the overall control of FIG. 6.

First, as illustrated in FIG. 6, when control starts, the printer controller 300 receives a printing instruction (step S101) and starts driving the apparatus or prepares to form an image (step S102). Thereafter, a humidity (current value) RH(a) of the developer is calculated (step S103). The flow of step S103 will be described in detail below with reference to FIG. 5.

As illustrated in FIG. 5, the printer controller 300 acquires a temperature (° C.) and a relative humidity (%) detected by the temperature and humidity sensor 53 and calculates an absolute water amount ABS (g/m$^3$) (step S001).

In general, there is a plurality of methods of calculating an absolute water amount (which is a water amount (g) in a dry air of 1 kg) from the temperature and the relative humidity. In this embodiment, the absolute water amount is calculated according to a state expression of a saturated water vapor pressure and an ideal gas as follows.

First, since the image forming apparatus according to this embodiment is used in the environments of almost one atmospheric pressure and a temperature of about 0° C. to 60° C., a calculating method with the approximate expression of Tetens is used.

The approximate expression of Tetens is an expression by which a saturated water vapor pressure E (τ) (Pa) is calculated at a temperature τ° C., $$E(\tau)=611\times10^{\wedge}(7.5\times\tau/(\tau+237.3) \qquad \text{Expression (1)}$$

(where, it is assumed that E is a saturated water vapor pressure water amount (Pa) and τ is a centigrade temperature (° C.)).

Next, a saturated absolute water amount (volume absolute humidity) ABSσ is calculated by a state expression of the ideal gas.

$$ABS\sigma(\text{g/m}^3)=2.1668\times E(\tau)/(\tau+273.15)$$

The saturated absolute water amount (volume absolute humidity) is calculated by this expression.

The absolute water amount ABS (g/m$^3$) at the temperature and humidity is calculated by multiplying the saturated absolute water amount ABSσ (g/m$^3$) by the value of the relative humidity (%).

Next, the printer controller 300 acquires the temperature T (the temperature of the development device, ° C.) of the first temperature sensor 51 and calculates the saturated absolute water amount ABSσ (g/m$^3$) of the temperature from the temperature T (° C.). Then, the humidity RH (b) (%) of the development device is calculated by dividing the ABS (g/m$^3$) detected or calculated by the temperature and humidity sensor 53 by the saturated absolute water amount ABSσ (step S002).

Likewise, the printer controller 300 calculates a supply toner humidity rh (%) from the temperature t (° C.) of the second temperature sensor 52 and the ABS detected or calculated by the temperature and humidity sensor 53 (step S003).

Next, the printer controller 300 reads a flag value F from a memory included therein and determines whether the flag value F is 0 (step S004). The flag value F indicates whether a toner residual amount detecting process to be described below is necessary (where, F=1) or not (where, F=0).

When the result of step S004 is Yes (where, the flag value F=0), the printer controller 300 determines that a sufficient amount of toner remains in the toner bottle 6 and the toner is thus supplied to the development device 1, and then the process proceeds to step S005.

Step S005 is a process of correcting the humidity RH(a) (the humidity (%) of the two-component developer present "inside" the development device 1) of the developer according to the supply toner amount z(g) to the development device 1 during an image forming operation.

In other words, in step S005, the humidity RH(a) is calculated by the following expression, $$RH(a)=RH(b)+\gamma\times(rh-RH(b))\times z \qquad \text{Expression (2)}$$

In Expression (2) above, it is assumed that: RH(a) is the humidity (%) of the two-component developer present inside the development device 1, RH(b) is the humidity (%) of (the outside of) the development device calculated in step S002, rh is the humidity (%) of the supply toner calculated in step S003, z is the amount of supplied toner (g), and γ is a coefficient (1/g) calculated by an experiment.

Thereafter, the humidity RH(a) is a control parameter used to determine an image formation condition in step S104 of FIG. 6. That is, image density stability can be maintained by performing correction by Expression (2) to the extent of an influence of the amount of supplied toner, the temperature, and the humidity on the temperature and humidity of the developer present inside the development device.

However, the value used as the supply toner amount z(g) is not a value recognized by the printer controller 300. The printer controller 300 controls the image forming apparatus using the driving time s (msec) of the toner supply screw 7 on the assumption that a supply capability r of the toner supply screw 7 per unit time is constant.

A case in which the assumption that "the supply capability r is constant" is not satisfied is a case in which a sufficient amount of toner does not remain in the toner bottle 6. That is, this case is a case in which a toner residual amount detecting process (which is described in detail below) is necessary (the flag value described above is "F=1", and No in step S004).

In the case of No (the flag value "F=1") in step S004, the printer controller 300 determines that an actual amount of supply toner suitable for the rotation of the toner supply screw 7 is not ensured.

In this case, the humidity (%) of (the outside of) the development device calculated in step S002 is set as follows. That is, a following expression is set (step S006).

$$RH(a)=RH(b) \qquad \text{Expression (3)}$$

Then, the process proceeds to step S104 of FIG. 6 and an image formation condition is determined according to the humidity RH(a).

As described above, according to the method described in this embodiment, the image density stability can be achieved by suppressing excessive correction caused due to a difference between the amount of supply toner recognized by the image forming apparatus and the actual amount of supplied toner.

(Description of Other Processes According to Embodiment) Hereinafter, a specific process order of the image forming apparatus according to this embodiment under the control of the printer controller 300 will be described with reference to the flowcharts of FIGS. 6 to 8.

In FIG. 6, the printer controller 300 receives a command of a printing instruction (step S101) and starts driving the image forming apparatus to prepare image formation (step S102).

Next, the printer controller 300 calculates the humidity RH(a) of the developer in the process of step S103 described above, and then calculates and sets the image formation condition based on the humidity RH(a) (step S104). In this embodiment, a method of adjusting Vcont with the exposure intensity of the laser 22 is used as the image formation condition. The exposure intensity of the laser 22 is calculated and set with reference to the humidity RH(a) and the table of FIG. 4.

When the image formation condition is set, the printer controller 300 causes the image forming apparatus to start a printing process (step S105). As described above, the detection value of the toner density sensor 54 is acquired during the printing process, and then the difference value ΔTD and the driving time s are sequentially calculated, and a toner supplying process is performed (step S106).

When the image formation ends, the printer controller 300 causes the image forming apparatus to perform post-processing of the image formation. Simultaneously, the difference value ΔTD calculated in step S106 is stored in the memory included in the printer controller 300 (step S107).

The printer controller 300 stores history data of the difference value ΔTD corresponding to the latest sixteen times including this time in the memory included therein. The printer controller 300 determines whether the difference value ΔTD corresponding to the latest five times is continuously −3% or less and determines whether the toner residual amount detecting process is necessary (step S108). Here, when the difference value ΔTD of the latest five times is continuously −3% or less, the flag value "F=1" is set.

First, a case in which the result of step S108 is No, that is, the toner residual amount detecting process is not necessary will be described. The printer controller 300 sets the flag value "F=0" which is a variable in the memory (step S113) and ends the process of the image forming apparatus (step S114). The reason why the flag value "F=0" is set in step S113 is that information regarding the fact that the toner residual amount detecting process is not necessary is stored. This information is used in step S103 in the subsequent printing process.

Conversely, when the result of step S108 is Yes, that is, the printer controller 300 determines that the toner residual amount detecting process is necessary, the printer controller 300 sets the flag value "F=1" (step S109). Thus, information regarding the fact that the toner residual amount detecting process is necessary is stored. This information is used in step S103 in the subsequent printing process.

Next, the toner residual amount detecting process is performed to confirm whether the toner remains in the toner bottle 6 (step S110). The control of step 110 will be described in detail with reference to FIG. 7. FIG. 7 is a flowchart illustrating control of the toner residual amount detecting according to the first embodiment.

Figure 7:
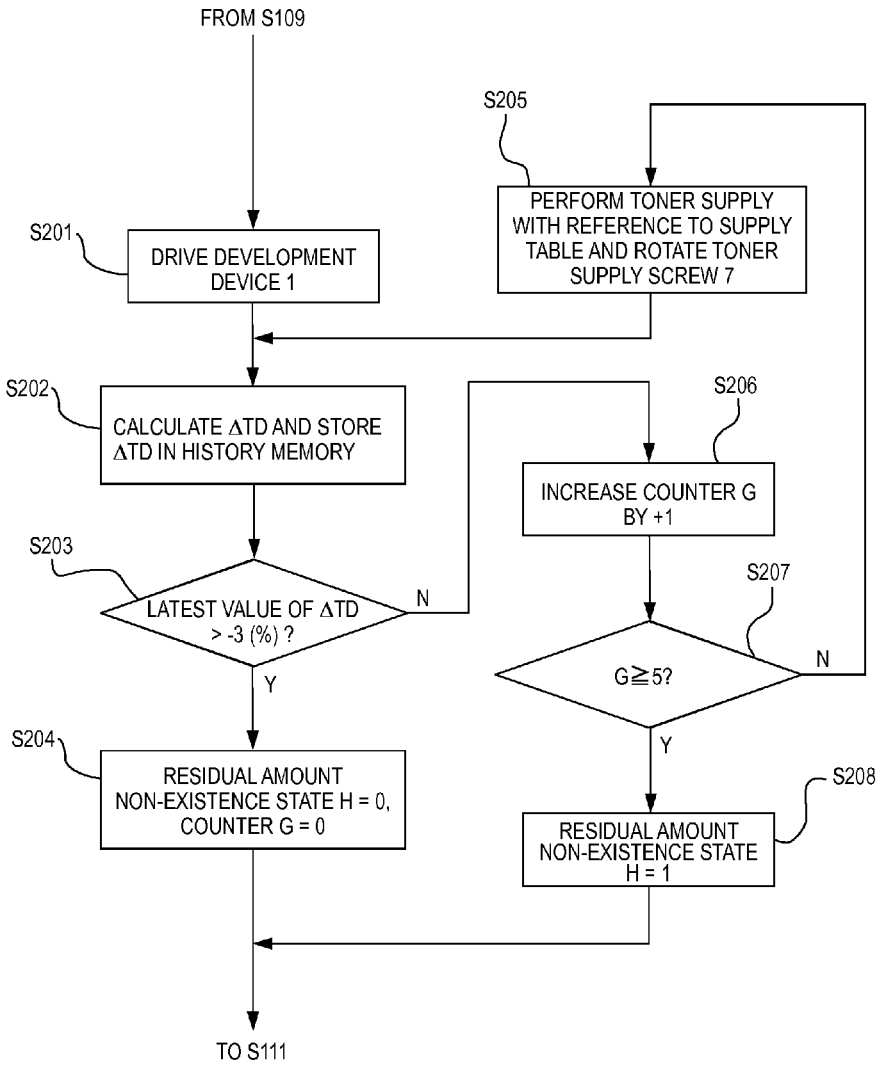
FIG. 7 is a flowchart illustrating control of detection of a remaining amount of toner according to the first embodiment.

The details of step S110 are illustrated in FIG. 7. In the flowchart of FIG. 7, the toner residual amount detecting process of steps S201 to S208 according to this embodiment are described.

The printer controller 300 first sets a driving state of the development device 1 (step S201), calculates the difference value ΔTD, and stores the difference value ΔTD in the history memory included therein (step S202).

Next, the printer controller 300 determines whether the latest value (which is the same as the currently calculated value) in the difference value ΔTD stored in the history memory is greater than −3(%) (step S203).

When the result of step S203 is Yes (where, the difference value ΔTD>−3), the toner density indicates return from the state of Y in step S108 to the toner density reference value. Therefore, it is determined that the state of the toner is not the residual amount non-existence state, a flag value H indicating a toner residual amount non-existence state is set to "H=0." At this time, a counter value G indicating how many times a process of step S205 to be described below is performed is simultaneously set to "G=0" (step S204).

Conversely, when the result of step S203 is No (where, the difference value ΔTD≤−3), the above-described counter value G is increased by +1 (step S206) and it is determined whether the counter value G is equal to or greater than 5 (where, G≥5) (step S207).

First, a case in which the result of step S207 is No (where, G<5) will be described. The toner supply screw 7 is rotated with reference to the toner supply table of FIG. 4. Thus, the toner supplying process is performed (step S205), and then the process proceeds to steps S202 and S203 again to confirm whether the toner density returns to the reference value.

A case in which the result of step S207 is Yes (where, G≥5) will be described. In this case, the history of the difference value ΔTD is equal to or less than −3 (%) at five times already, when the result of step S108 is Yes. Thereafter, the process proceeds to step S205 and the difference value ΔTD further becomes equal to or less than −3 (%) at five times and a total of ten times, while performing the toner supplying process. At this time, the printer controller 300 determines that there is no residual amount of toner, the flag value H is set to "H=1" (step S208).

Thus, after the flag value H is determined by performing step S110, the value of the flag value H is determined in step S111. When the result of step S111 is Yes, it is necessary to exchange the toner bottle 6 of corresponding color. Therefore, "toner non-existence" is displayed on a user interface (not illustrated) of the image forming apparatus and a printing prohibition state is set (step S112). When the result of step S111 is No, a process is paused normally to prepare for the subsequent printing process (step S114).

Figure 8:
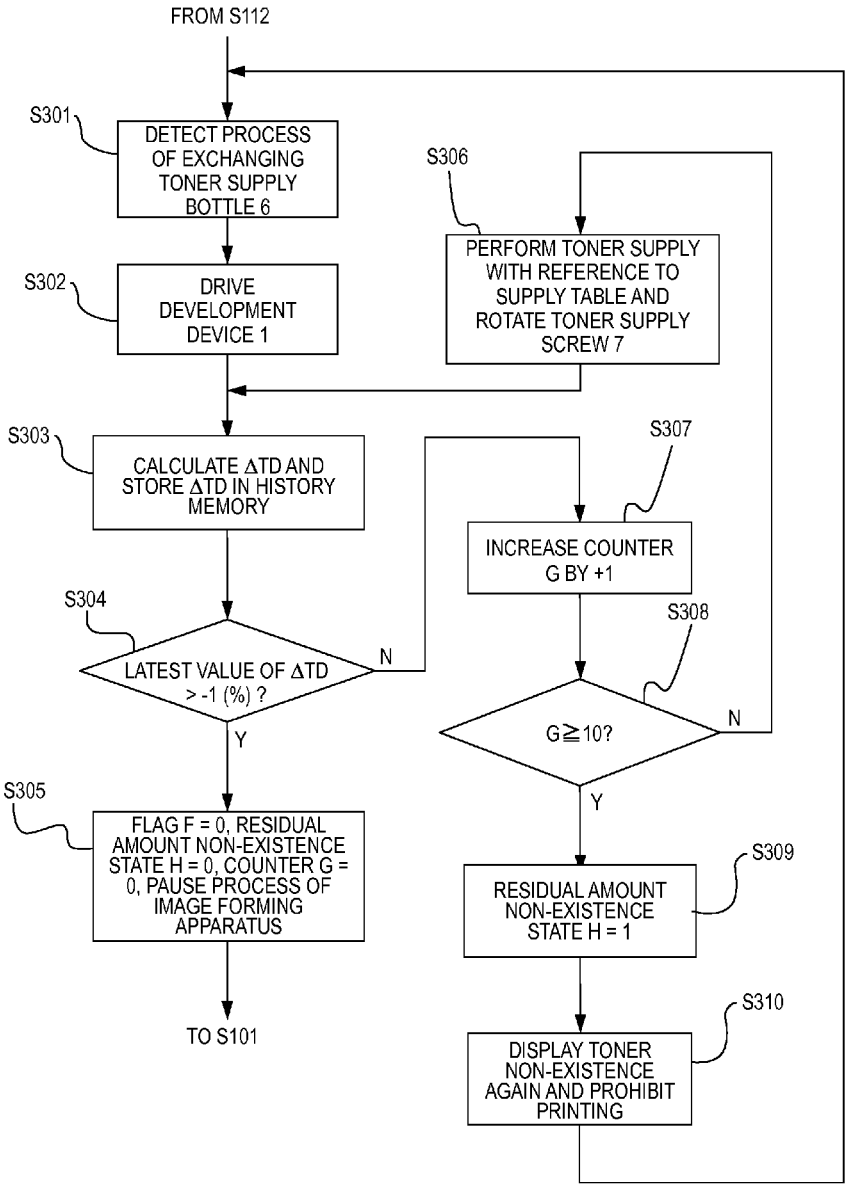
FIG. 8 is a flowchart illustrating control of toner supply confirmation according to the first embodiment.

When the process proceeds to step S112, the printer controller 300 enters "a flow of toner bottle exchange confirmation" illustrated in FIG. 8. FIG. 8 is a flowchart illustrating control of toner supply confirmation according to the first embodiment.

As illustrated in FIG. 8, the printer controller 300 waits for occurrence of an inevitable event, when a process of exchanging the toner bottle 6 is performed. Examples of the event are considered to include openness or closeness of a door of a portion accommodating the toner bottle 6 or a change in an individual identification number or toner residual amount approximate value information using a non-volatile memory or the like subordinate to the toner bottle 6.

The process of exchanging the toner bottle 6 is detected (step S301) and the development device 1 is first driven (step S302).

Next, a value detected by the toner density sensor 54 is acquired in the state in which the development device 1 is driven, the difference value ΔTD is calculated, and the difference value ΔTD is stored in the history memory (step S303). Here, it is determined whether the latest difference value ΔTD (currently calculated value) in the history memory is greater than −1% (step S304).

Here, in the first number of time after the process of exchanging the toner bottle 6, the difference value ΔTD becomes a value immediate after it is determined that the difference value ΔTD is equal to or less than −3% (where, the difference value ΔTD≤−3) in step S203 of FIG. 7. Therefore, when the result of step S304 in the first number of time is determined to be Yes (where, the difference value ΔTD>−1), abnormality is considered. However, a treatment for the abnormality will not be described.

When the result of step S304 is determined to be No (where, the difference value ΔTD≤−1), the counter value G used in step S206 is increased by one (step S307). Thereafter, it is determined whether the counter value G is equal to or greater than 10 (step S308).

When the result of step S308 is Yes (where, G≥10), it is determined that the toner bottle 6 apparently changed is empty, and thus the toner non-existence is displayed again as the residual amount non-existence state (where, H=1) and the printing prohibition state continues (step S310).

When the result of step S308 is No (where, G<10), the toner is supplied, but the detection by the toner density sensor 54 is not performed. Therefore, the toner supply screw 7 is rotatably driven for an appropriate time according to the latest difference value ΔTD, referring to the supply table of FIG. 4.

Thereafter, the process returns to step S303 and the control is repeated until it is determined that the result of step S304 is Yes (where, the difference value ΔTD>−1) due to the supplied toner. That is, a loop process is performed in the order of step S307, step S308, step S306, step S303, and step S304.

Thereafter, when it is determined that the result of step S304 is Yes (where, the difference value ΔTD>−1), the process proceeds to step S305. Then, the flag value "F=0" is set, the flag value indicating the residual amount non-existence "H=0" is set, the counter value "G=0" is set, and the process of the image forming apparatus is paused. The process returns to step S101 of FIG. 6 to enter a printing instruction waiting state.

Here, the humidity RH(a) of the developer is preferably corrected in subsequent step S103 in consideration of the toner supplied during the loop process. In this case, a treatment such as correction of z to the maximum value (which is calculated from the maximum value of the driving time s) by Expression (2) is considered.

As described above, the CPU 301 sets the change amount of the image formation condition by the control parameters to be smaller when it is determined that it is necessary to perform the residual amount detecting process than when it is determined that it is not necessary to perform the residual amount detecting process. Further, the control may be performed based on at least one of the previously used temperature and humidity condition of the development device 1 and the image formation condition of the image forming apparatus.

In this embodiment, "RH(a)=RH(b)" is set as in Expression (3) of step S006 and the correction amount is set to be zero, but the invention is not limited thereto. For example, the correction amount may be suppressed to a predetermined ratio such as 80% of normal amount.

[Second Embodiment] A second embodiment of the invention will be described. An image forming apparatus according to this embodiment is almost the same as the image forming apparatus according to the embodiment described above, but there are two differences. That is, a calculation expression of the humidity (current value) RH(a) of the developer in steps S005 and S006 of FIG. 5 is different, and thus the second temperature sensor 52 illustrated in FIGS. 2 and 3 is not provided. Hereinafter, the details will be described.

Figure 9:
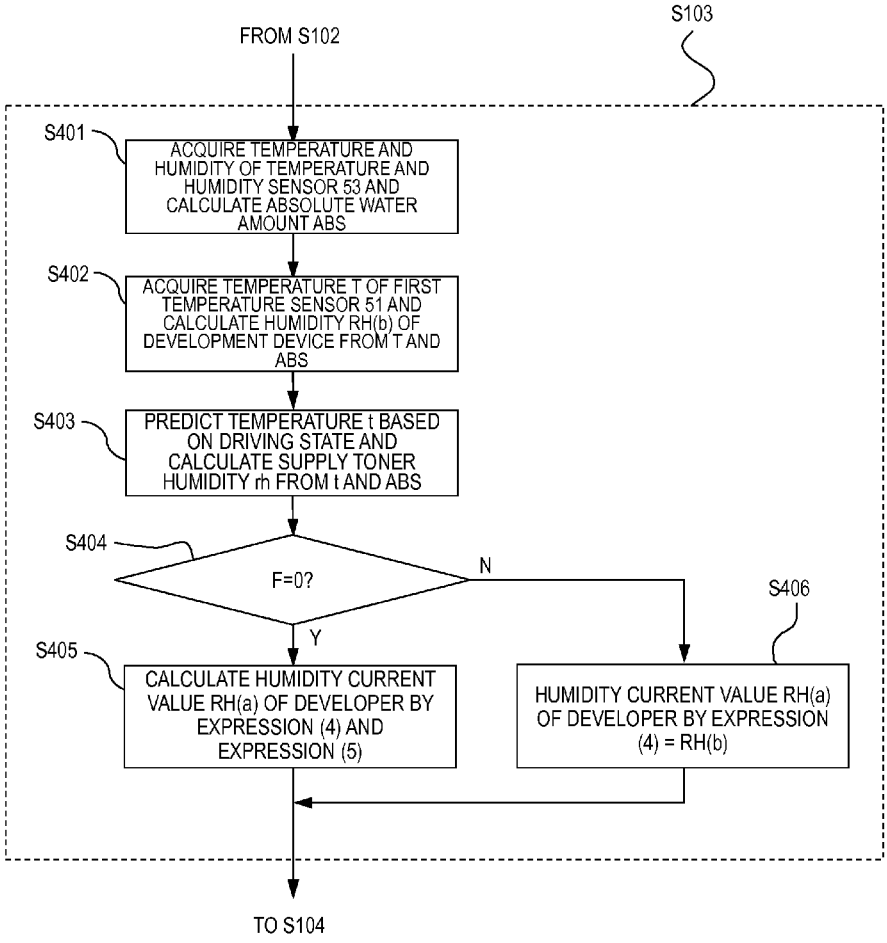
FIG. 9 is a flowchart illustrating control of humidity calculation according to a second embodiment.

(Characteristics of Embodiment) FIG. 9 is a flowchart illustrating control of humidity calculation according to a second embodiment. The characteristics of this embodiment will be described in detail with reference to FIG. 9. The flowchart of FIG. 9 is illustrated as step S103 described in the overall flowchart of the image forming apparatus described in FIG. 6 according to the first embodiment.

Step S401 of FIG. 9 describes the same details as step S001 of FIG. 5. Step S402 of FIG. 9 describes the same details as step S002 of FIG. 5.

In step S403, in the printer controller 300 according to the first embodiment, the second temperature sensor 52 detects the temperature t of the toner bottle 6. In the second embodiment, the printer controller 300 calculates the temperature t of the toner bottle 6 as an expected value. A method of predicting the temperate t is as follows.

(1) A temperature j(° C.) of the temperature and humidity sensor 53 is acquired.

(2) When a printing process starts, the following expression is set:

$$t(°\,C.)=j+\text{elapsed time } u \text{ (min) from the start}\times\text{temperature increase gradient } M(°\,C./\text{min}).$$

(3) When t reaches "j+target temperature difference K(° C)", "t=j+K" is set.

(4) When the printing process ends, the following expression is set as a target temperature difference "K=0 (° C)":

$$t(°\,C.)=j+\text{elapsed time } u \text{ (min) from the end}\times\text{temperature decrease gradient } N(°\,C./\text{min}).$$

(5) When t reaches j, "t=j" is set.

Next, the printer controller 300 reads the flag value F from the memory included therein and determines whether the flag value F is 0 (step S404). The flag value F indicates whether the toner residual amount detecting process is necessary (where, F=1) or is not necessary (where, F=0).

When the result of step S404 is Yes (where, F=0), the printer controller 300 determines that the toner is supplied to the development device 1 due to the fact that a sufficient amount of toner remains in the toner bottle 6, and then the process proceeds to step S405.

In this embodiment, step S405 includes the following two stages.

<1> This stage is a process of interpolating a difference between RH(m), which is the previous humidity RH(a) of the developer stored in the printer controller 300, and the humidity RH(b) of (the outside of) the development device 1 calculated this time in step S402 by an exponential function according to a ratio between the elapsed time k (min) and a time constant β (min).

<2> This stage is a process of further correcting a change in the humidity caused due to the supplied toner, as in step S405 according to the first embodiment.

First, the value of RH(c) is calculated as an intermediate value of the value calculated in <1> by Expression (4) below.

That is, the following expression is calculated:

$$RH(c)=(RH(m)-RH(b))*\exp(-k/\beta)+RH(b) \qquad \text{Expression (4)}$$

Next, in <2>, RH(a) is calculated as follows by Expression (5) below using the humidity RH(c) instead of the humidity RH(a) of the developer.

$$RH(a)=RH(c)+\gamma\times(rh-RH(c))\times z \qquad \text{Expression (5)}$$

The change in the humidity caused due to the supplied toner is corrected by this expression.

Here, the meanings of the signs in Expression (4) and Expression (5) are as follows: RH(a) is the current value (%) of the humidity of the developer, RH(b) is the humidity (%) of (the outside of) the development device calculated in step S402, RH(c) is an intermediate value (%) used in the calculation of RH(a), RH(m) is the previous RH(a) (%) stored in the memory, rh is the humidity (%) of the supply toner calculated in step S403, k is the elapsed time (min) from the calculation time of the previous humidity RH(a) to this calculation, z is a supply toner amount (g), γ is a coefficient (1/g) calculated by an experiment, and β is a coefficient (min) calculated by an experiment.

Here, β indicates that a speed at which the humidity RH(m) of the two-component developer in the development device 1 at the previous calculation time approaches the humidity RH(b) of the outside of the development device 1 during the elapsed time of k (min) is represented as a time constant. By calculating the humidity by Expression (4), the developer humidity RH(a) (%) of the two-component developer in the development device 1 can be calculated with more accuracy.

When the result of step S404 is No (where, F=1), the printer controller 300 performs only the process of calculating the humidity by Expression (4) (step S406). Thus, as in the first embodiment, the image density stability can be achieved by suppressing excess correction caused due to a difference between the amount of supply toner recognized by the image forming apparatus and the actual amount of supplied toner. In particular, in this embodiment, the advantages of the invention can obtained better, since the humidity RH(a) of the developer corrected by Expression (4) has an influence on the calculation of the subsequent humidity RH(a).

[Other Embodiments] The control parameters used in the control are not limited to the parameters described above in the embodiments. For example, the control parameters may include at least one of image data to be output, the exposure amount of an exposure device, a detection result of the toner density sensor, and the process time and/or the process amount when the supply screw 7 supplies the developer to the development device 1.

The following control may be performed. Examples of the parameter associated with the supply amount of the supply developer include: an exposure time integration value in which the exposure device exposes the photosensitive drum at the printing time, the toner density of the two-component developer, and the attachment amount of a reference toner image obtained by developing a reference latent image.

Further, there is the plurality of image formation conditions. Among the image formation conditions, at least one of the following parameters is preferably adjusted: all conditions (potential and the like) by which an electrostatic latent image is formed, a primary charging amount by which the photosensitive drum is uniformly charged, a development bias (including an alternating-current component) to be applied to the development device, a current value or voltage value of the primary transfer bias, an exposure amount by which the exposure device exposes the photosensitive drum per predetermined area, a lookup table by which the exposure amount of the exposure device is determined in correspondence with the image data, and a current value and/or a voltage value to be applied to the intermediate transfer member.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2012-004903, filed Jan. 13, 2012, which is hereby incorporated by reference herein in its entirety.

What is claimed is:

1. An image forming apparatus comprising:

a developing device that accommodates a developer including at least toner and a carrier and visualizes an electrostatic latent image carried on an image bearing member as a toner image;

a supply device that accommodates a developer including at least the toner and supplies the developer to the developing device;

a controller that controls an image formation condition based on first information regarding a humidity of the developer accommodated in the developing device, second information regarding a humidity of the developer accommodated in the supply device, and third information regarding a supply amount supplied by the supply device; and a supply amount controller that controls the supply amount of the supply device based on a detection value of a toner density detecting portion and a predetermined target value, wherein according to a detection result of the toner density detecting portion, in a case when the supply amount controller repeatedly detects the detection value of the toner density detecting portion is equal to or less than the predetermined target value, the supply amount controller performs a mode in which the toner density in the developing device returns to higher than the predetermined target value after stopping an image forming performance, and wherein in a period from starting a performance of the mode to finishing the performance of the mode after stopping a next image forming process, the controller controls a feedback ratio of the second information and the third information.

2. The image forming apparatus according to claim 1, further comprising:

a temperature and humidity detecting sensor that detects a temperature and a humidity of an inside or a vicinity of the image forming apparatus; and a temperature sensor that detects a temperature in a vicinity of the developing device, wherein the first information and the second information are acquired based on detection values of the temperature and humidity detecting sensor and the temperature sensor.

3. The image forming apparatus according to claim 1, further comprising a toner density detecting portion that detects at least one of an optical characteristic of the developer accommodated in the developing device, a magnetic characteristic of the developer accommodated in the developing device, and an attachment amount of a reference toner image obtained by developing a reference latent image formed on the image bearing member by the developing device.

4. The image forming apparatus according to claim 1, further comprising:

a first temperature sensor that detects a temperature in a vicinity of the developing device; and a second temperature sensor that detects a temperature in a vicinity of the supply device, wherein the first information and the second information are acquired based on detection results of the first and second temperature sensors, respectively.

5. The image forming apparatus according to claim 1, wherein the controller acquires the first information based on first previously acquired humidity information regarding the developer accommodated in the developing device and second humidity information obtained based on a first temperature sensor.

6. The image forming apparatus according to claim 1, wherein the third information includes at least one of image data to be output, an exposure amount by which the image bearing member is exposed by an exposure device that forms an electrostatic latent image by irradiating the image bearing member, a detection result of a toner density detecting portion, and a process time and/or a process amount when the supply device performs a process of supplying the developer to the developing device.

7. The image forming apparatus according to claim 1, wherein the image formation condition is at least one of a primary charging amount used to uniformly charge the image bearing member, a lookup table used to determine an exposure amount of an exposure device in correspondence with image data to be output, an exposure amount by which the exposure device exposes the image bearing member per predetermined area, a potential of the electrostatic latent image, a development bias to be applied to the developing device, and a current value and/or a voltage value to be applied to a transfer portion that transfers the toner image from the image bearing member to an intermediate transfer member.

8. The image forming apparatus according to claim 1, wherein, when the third information is constant, and a difference value between the first information and the second information is large, a change amount of the image formation condition is increased.

9. The image forming apparatus according to claim 1, wherein, when the first information and the second information are different and a difference value between the first information and the second information is constant, the controller controls such that as the third information is large, a change amount of the image formation condition is increased.

10. An image forming apparatus comprising:

a developing device that accommodates a developer including at least toner and a carrier and visualizes an electrostatic latent image carried on an image bearing member as a toner image;

a supply device that accommodates a developer including at least the toner and supplies the developer to the developing device;

a humidity sensor for detecting an ambient humidity of a main assembly of the image forming apparatus;

a first temperature sensor for detecting an ambient temperature of the main assembly of the image forming apparatus;

a second temperature sensor for detecting an ambient temperature of the developing device; and a controller for controlling an image forming condition based on information of a supply amount by the supply device, the detection results of the humidity sensor and the first temperature sensor, and the second temperature sensor, wherein the controller controls the image forming condition based on detection results of the humidity sensor and the first temperature sensor, and the second temperature sensor obtained a previous time;

time information regarding the detection results of the humidity sensor and the first temperature sensor, and the second temperature sensor obtained the previous time;

detection results of the humidity sensor and the first temperature sensor, and the second temperature sensor obtained at a present time;

time information regarding the detection results of the humidity sensor and the first temperature sensor, and the second temperature sensor obtained at the present time.

11. The image forming apparatus according to claim 10, further comprising;

a toner density detecting portion that detects toner density in a developing device; and a supply amount controller that controls the supply amount of the supply device based on a detection value of a toner density detecting portion and a predetermined target value, wherein according to a detection result of the toner density detecting portion, in a case when the supply amount controller repeatedly detects the detection value of the toner density detecting portion is equal to or less than the predetermined target value, the supply amount controller performs a mode in which the toner density in the developing device returns to higher than the predetermined target value after stopping image forming performance, and wherein in a period from starting a performance of the mode to finishing the performance of the mode after stopping a next image forming process, the controller controls a feedback ratio of the second information and the third information.

12. The image forming apparatus according to claim 10, wherein the image formation condition is developing contrast as an electric potential difference between a developing DC component and an electric potential of an image portion on the image bearing member.

13. An image forming apparatus comprising:

a developing device that accommodates a developer including at least toner and a carrier and visualizes an electrostatic latent image carried on an image bearing member as a toner image;

a supply device that accommodates a developer including at least the toner and supplies the developer to the developing device;

a humidity sensor for detecting an ambient humidity of a main assembly of the image forming apparatus;

a first temperature sensor for detecting an ambient temperature of the main assembly of the image forming apparatus;

a second temperature sensor for detecting an ambient temperature of the developing device;

a controller for controlling an image forming condition based on the information of a supply amount by the supply device, the detection results of the humidity sensor and the first temperature sensor, and the second temperature sensor;

a toner density detecting portion that detects toner density in the developing device; and a supply amount controller that controls the supply amount of the supply device based on a detection value of a toner density detecting portion and a predetermined target value, wherein according to a detection result of the toner density detecting portion, in a case when the supply amount controller repeatedly detects the detection value of the toner density detecting portion is equal to or less than the predetermined target value, the supply amount controller performs a mode in which the toner density in the developing device returns to higher than the predetermined target value after stopping an image forming performance, and wherein in a period from starting a performance of the mode to finishing the performance of the mode after stopping a next image forming process, the controller controls a feedback ratio of the second information and the third information.

* * * * *